US011399695B2

(12) United States Patent
Terrádez Alemany et al.

(10) Patent No.: US 11,399,695 B2
(45) Date of Patent: Aug. 2, 2022

(54) HOUSEHOLD DISHWASHER MACHINE AND METHOD FOR OPERATING A HOUSEHOLD DISHWASHER MACHINE

(71) Applicant: BSH Hausgeräte GmbH, Munich (DE)

(72) Inventors: Maria Terrádez Alemany, Munich (DE); Kai Paintner, Welden (DE); Matthias Heckes, Munich (DE); Daniel Hitzler, Dillingen (DE)

(73) Assignee: BSH Hausgeräte GmbH, Munich (DE)

( * ) Notice: Subject to any disclaimer, the term of this patent is extended or adjusted under 35 U.S.C. 154(b) by 139 days.

(21) Appl. No.: 16/619,102

(22) PCT Filed: Jul. 6, 2018

(86) PCT No.: PCT/EP2018/068331
§ 371 (c)(1),
(2) Date: Dec. 4, 2019

(87) PCT Pub. No.: WO2019/015991
PCT Pub. Date: Jan. 24, 2019

(65) Prior Publication Data

US 2020/0138263 A1 May 7, 2020

(30) Foreign Application Priority Data

Jul. 19, 2017 (DE) ..... 10 2017 212 313.3

(51) Int. Cl.
*A47L 15/42* (2006.01)
*A47L 15/00* (2006.01)

(52) U.S. Cl.
CPC ..... *A47L 15/4295* (2013.01); *A47L 15/0028* (2013.01); *A47L 15/0034* (2013.01);
(Continued)

(58) Field of Classification Search
CPC ..... A47L 15/4295; A47L 2401/04; A47L 15/0034; G03B 15/05
See application file for complete search history.

(56) References Cited

U.S. PATENT DOCUMENTS 3,870,417 A 3/1975 Bashark
10,080,477 B2 9/2018 Fauth et al.
(Continued)

FOREIGN PATENT DOCUMENTS

DE 102005055411 A1 5/2007
DE 102013219054 A1 * 3/2015 ..... H04W 12/50
(Continued)

OTHER PUBLICATIONS

EP1344487A2 Machine Translation (Year: 2003).*
(Continued)

*Primary Examiner* — Spencer E. Bell
(74) *Attorney, Agent, or Firm* — Michael E. Tschupp; Andre Pallapies; Brandon G. Braun

(57) ABSTRACT

A household dishwasher includes a washing compartment receiving items to be washed, a control device configured to carry out a washing program selected from a number of washing programs for washing the items to be washed in the washing compartment, an optical sensor configured to acquire an optical sensor signal of the items to be washed in the washing compartment, and an evaluation unit configured to identify a drying state of the items to be washed in the washing compartment as a function of the acquired optical sensor signal.

12 Claims, 2 Drawing Sheets

(52) U.S. Cl.
CPC ..... *A47L 2401/04* (2013.01); *A47L 2401/19* (2013.01); *A47L 2401/30* (2013.01)

(56) References Cited

U.S. PATENT DOCUMENTS

| | | | | |
|---|---|---|---|---|
| 2010/0139690 | A1* | 6/2010 | Gaus | A47L 15/4223 134/1 |
| 2012/0060875 | A1* | 3/2012 | Fauth | A47L 15/4295 134/56 D |
| 2016/0234035 | A1* | 8/2016 | Boeldt | H04L 12/2821 |
| 2021/0333691 | A1* | 10/2021 | Gammons | H04N 5/2256 |

FOREIGN PATENT DOCUMENTS

| | | | |
|---|---|---|---|
| DE | 102015107521 | A1 | 11/2016 |
| EP | 1344487 | A2 | 9/2003 |
| EP | 3375931 | B1 | 10/2019 |
| JP | 2003235781 | A | 8/2003 |
| WO | 2004071581 | A1 | 8/2004 |

OTHER PUBLICATIONS

JP2003235781A Machine Translation (Year: 2003).*
National Search Report DE 10 2017 212 313.3 dated Apr. 4, 2018.
International Search Report PCT/EP2018/068331 dated Oct. 10, 2018.

* cited by examiner

HOUSEHOLD DISHWASHER MACHINE AND METHOD FOR OPERATING A HOUSEHOLD DISHWASHER MACHINE

CROSS-REFERENCES TO RELATED APPLICATIONS

This application is the U.S. National Stage of International Application No. PCT/EP2018/068331, filed Jul. 6, 2018, which designated the United States and has been published as International Publication No. WO 2019/015991 A1 and which claims the priority of German Patent Application, Serial No. 10 2017 212 313.3, filed Jul. 19, 2017, pursuant to 35 U.S.C. 119(a)-(d).

BACKGROUND OF THE INVENTION

The present invention relates to a household dishwasher and a method for operating a household dishwasher.

Two criteria are particularly important to consumers when choosing a household dishwasher: the dishes must come clean and they must come out of the household dishwasher as dry as possible. With regard to the cleanliness of the dishes, a method is known for example from WO 2004/071681 A1 in which the washing liquor is analyzed for dirt particles by means of an image recognition unit, permitting conclusions to be drawn as to the cleanliness of the dishes.

In particular if the dishes are still wet following a washing cycle, this means a not insignificant restriction for the user, who cannot immediately put these dishes away in the place provided for this purpose but must first dry them by hand or arrange them on a corresponding rack to air-dry.

Various methods for improving the drying performance of a dishwasher are known, such as the use of rinse aid, zeolite drying units, condensation drying and/or automatic door opening. Each of these methods has its own advantages. Situations nevertheless arise in which the dishes are not completely dry after completion of the washing cycle or moisture recondenses back onto the dishes.

BRIEF SUMMARY OF THE INVENTION

Against this background, an object of the present invention consists in providing an improved household dishwasher.

Accordingly, a household dishwasher with a control device for carrying out a washing program selected from a number of washing programs for washing items to be washed arranged in a washing compartment is proposed. The household dishwasher has an optical sensor for acquiring an optical sensor signal of the washing compartment and an evaluation unit. The evaluation unit is configured to identify a drying state of the items to be washed arranged in the washing compartment as a function of the acquired optical sensor signal of the washing compartment.

Such a household dishwasher has the advantage that the drying state of the items to be washed can be identified. Based on the identified drying state of the items to be washed, a wide variety of advantageous measures can be initiated, such as measures for faster drying of the items to be washed, for preventing recondensation onto the items to be washed, and/or an output of an indication to the user regarding the optimum point in time at which to remove the dishes from the household dishwasher.

The control device can be implemented as hardware and/or software. If implemented as hardware, the control device can be embodied for example as a computer or microprocessor. If implemented as software, the control device can be embodied as a computer program product, as a function, as a routine, as part of a program code or as an executable object.

The control device is configured to carry out a washing program selected from a number of washing programs for washing the items to be washed. A washing program comprises for example different program sub-steps, such as a pre-rinse, a cleaning, a rinsing and/or a drying. Different washing programs differ for example with regard to a sequence and/or type of program sub-steps and with regard to different parameters, such as a duration and/or washing liquor temperature of one or several program sub-steps.

In particular a drying is provided as the final program sub-step in a respective washing program, during which the items to be washed are dried. The drying can be carried out in different ways, depending on the embodiment of the household dishwasher.

For example, a condensation drying can be provided. Preparation is made for this for example by a high washing liquor temperature being selected in the program sub-step preceding the drying so that the washing liquor is heated up to the high temperature. During the drying, a side wall of a dishwasher cavity of the household dishwasher is now cooled, for example. This causes moisture to be condensed from the air in the washing compartment onto the side wall, thus removing moisture from the air. As a result, the air can once again absorb moisture from the items to be washed. On account of the high temperature of the items to be washed, moisture remaining on the items to be washed evaporates particularly well.

A zeolite drying unit can also be provided, for example. The zeolite drying unit is configured to absorb moisture from the air in the washing compartment. A fan is provided, for example, which circulates the air of the washing compartment and guides it through the zeolite drying unit. It can further be provided that a fan conveys moist air out of the washing compartment. Moreover, a fan can be used to blow out liquid water which has collected for example in a depression of a pot and/or a bowl.

Items to be washed are arranged in the washing compartment, in particular on one or several receptacles for items to be washed, for washing with the household dishwasher. The items to be washed comprise in particular various dishes, items of cutlery and/or tools which are used for preparing, storing and/or consuming foods. These are for example plates, pots, cups, knives, glasses and the like. The items to be washed thus comprise in particular objects made from different materials, such as porcelain, glass, wood, metal and/or plastic. The drying depends in particular on the material and/or the surface of the items to be washed. Plastic items to be washed, for example, dry relatively less effectively than porcelain items to be washed on account of a hydrophobic surface and a lower heat capacity of the plastic in comparison to porcelain items to be washed.

The optical sensor is in particular embodied as an optoelectronic sensor, which makes an analog electrical signal available as the optical sensor signal as a function of an optical signal. This offers the advantage that the optical sensor is integrated on a microchip and can therefore be manufactured and used in a manner which saves on space and material and is cost-effective. Moreover, the analog electrical signal can be converted into a digital signal with little outlay, for example by means of an A/D converter, and then processed digitally.

The optical sensor is in particular arranged in the household dishwasher such that it can acquire an optical sensor signal of the washing compartment and in particular of the items to be washed arranged in the washing compartment. This is achieved for example if there is a line of sight from the washing compartment to the optical sensor. The optical sensor is arranged for example on a ceiling of the washing compartment, on a rear wall of the washing compartment and/or on a door of the household dishwasher, which in the closed state forms the washing compartment in conjunction with the dishwasher cavity. It can further be provided for multiple optical sensors to be used, wherein each of the optical sensors in each case acquires an optical sensor signal of a region assigned to the optical sensor.

The optical sensor is in particular configured to acquire the optical sensor signal over a broad spectral range, which is not limited to the optical spectral range.

The optical sensor comprises for example a camera, in particular a digital camera, for example with a CCD sensor (CCD: Charged Coupled Device). The camera acquires for example an image and/or an image sequence of the washing compartment and in particular of the items to be washed arranged therein.

A lighting device which illuminates the washing compartment can be provided by way of support. This lighting device can in particular be embodied as a narrowband light source, such as a laser. Alternatively, the lighting device can be embodied as a broadband light source, such as a light bulb and/or a flash unit.

The evaluation unit can be implemented as hardware and/or software. If implemented as hardware, the evaluation unit can be embodied for example as a computer or microprocessor. If implemented as software, the evaluation unit can be embodied as a computer program product, as a function, as a routine, as part of a program code or as an executable object. The evaluation unit can be embodied in particular as a part of the control device.

The evaluation unit is configured to identify the drying state of the items to be washed as a function of the acquired optical sensor signal. For example, the evaluation unit processes and/or analyzes the optical sensor signal accordingly to this end. The evaluation unit can be configured for example to carry out a spectral analysis of the optical sensor signal. In particular, such an analysis of an infra-red spectral range of the acquired sensor signal makes it possible to detect molecular water, as a result of which conclusions can be drawn directly or indirectly regarding the drying state.

If the optical sensor is embodied as a camera, then the evaluation unit can be configured in particular to carry out an image analysis of the optical sensor signal present as an image. Here, an image analysis comprises for example a recognition of water drops and/or regions wetted with water on the items to be washed.

The drying state is identified for example as a percentage specification, wherein 100% for example means that the items to be washed are completely dry. The drying state can also be referred to as drying progress. The drying state can also comprise a development of the drying of the items to be washed, for example a prediction as to when the items to be washed will be dry.

According to one embodiment of the household dishwasher, the household dishwasher has a lighting device for illuminating the washing compartment during acquisition of the optical sensor signal.

This embodiment is particularly advantageous in that it enables an optical signal to be acquired with a high signal-to-noise ratio even when the door of the household dishwasher is closed. Furthermore, the use of a special lighting device makes it possible to acquire optical sensor signals in spectral ranges which would otherwise be inaccessible, such as microwaves and/or terahertz radiation. Furthermore, it is possible through excitation of specific absorption bands of the water molecule to identify a water content in the air and/or water on the items to be washed, as a result of which the drying state of the items to be washed can be identified more precisely.

According to a further embodiment of the household dishwasher, the optical sensor is configured to acquire an optical sensor signal of the items to be washed arranged in the washing compartment.

According to a further embodiment of the household dishwasher, the lighting device is configured to illuminate the items to be washed arranged in the washing compartment during acquisition of the optical sensor signal.

According to a further embodiment of the household dishwasher, the optical sensor is embodied as a camera, wherein the optical sensor signal comprises an image of the washing compartment.

According to a further embodiment of the household dishwasher, the evaluation unit is configured to carry out an image analysis of the acquired image in order to identify the drying state of the items to be washed.

According to a further embodiment of the household dishwasher, the optical sensor is embodied as an infra-red sensor.

According to a further embodiment of the household dishwasher, the infra-red sensor is configured to acquire a temperature of the items to be washed and to acquire a relative air humidity of air in the washing compartment, wherein the evaluation unit is configured to identify the drying state of the items to be washed as a function of the acquired temperature of the items to be washed and the acquired relative air humidity.

If the temperature of the items to be washed is high and the relative air humidity of the air is low, it can be assumed that the items to be washed are substantially dry. Conversely, if the temperature of the items to be washed is low and the air humidity of the air is high, it can be assumed that moisture is condensing onto the items to be washed. In this case, reference is also made for example to recondensation.

According to a further embodiment of the household dishwasher, the evaluation unit is configured to trigger a predetermined action as a function of the identified drying state of the items to be washed.

According to a further embodiment of the household dishwasher, the predetermined action comprises a termination of the washing program, an extension of the washing program, a setting of a parameter value of the washing program, an output of a notification signal and/or an actuation of a component of the household dishwasher.

A setting of a parameter value of the washing program comprises in particular one or several of the following measures: opening of the door of the household dishwasher, activation of a fan to circulate the air in the washing compartment, activation of a zeolite drying unit, cooling down of a side wall of the dishwasher cavity and/or activation of an air heating device.

The output of a notification signal comprises in particular an output of a signal to a user by means of a user interface. The user interface comprises for example a display element and/or a loudspeaker. The user interface comprises in particular a communication unit, which for example transmits a notification via a network to a mobile device or an app installed on a mobile device of the user. Here, the network comprises in particular a mobile radio network, a WLAN and/or a further wireless or wired data network. This embodiment has the advantage that the user can be informed about the optimum point in time at which to remove the items to be washed. In particular, the time remaining until the items to be washed are completely dry can for example be displayed or transmitted on the display element and/or by means of the communication unit.

In embodiments of the household dishwasher, it can be provided that the user acquires a further optical sensor signal of the washing compartment and/or of the items to be washed by means of an optical sensor integrated in a mobile device, in particular a camera of a smartphone, which optical sensor signal is transmitted from the mobile device, in particular wirelessly, to the evaluation unit. The evaluation unit is configured to identify the drying state as a function of the further optical sensor signal.

In embodiments, it can further be provided that the optical sensor signal is transmitted for the purpose of identifying the drying state to a server, for example via the Internet, wherein the server identifies the drying state as a function of the transmitted sensor signal and transmits it to the household dishwasher.

According to a further aspect, a method for operating a household dishwasher is proposed. The household dishwasher has a control device for carrying out a washing program selected from a number of washing programs for washing items to be washed arranged in a washing compartment. In a first method step, the washing program is carried out by means of the control device. In a second method step, an optical sensor signal of the washing compartment is acquired by means of an optical sensor. In a third method step, a drying state of the items to be washed arranged in the washing compartment is identified by an evaluation unit as a function of the acquired optical sensor signal.

This method advantageously makes it possible to optimize the operation of the household dishwasher with regard to the drying state.

In embodiments of the method, it can be provided to transmit the acquired optical sensor signal to a mobile device, in particular a smartphone, and/or to a server, such as a backend. The mobile device and/or the server are in particular embodied as the evaluation unit and configured to identify the drying state as a function of the transmitted sensor signal. On a mobile device, the identification of the drying state can be carried out in particular by means of an app running on the mobile device.

The drying state of the items to be washed can further be identified at any time during a washing program, in particular during a drying program sub-step and/or also after completion of the washing program. In particular as a result of identifying the drying state after the end of a washing program but before a user removes the items to be washed from the washing compartment, it can be provided for example to prevent a recondensation of moisture onto the items to be washed by means of a door opening and/or a fan.

The embodiments and features described for the proposed household dishwasher apply correspondingly to the proposed method.

Furthermore, a computer program product is proposed which initiates the execution of the method as described above on a program-controlled device.

A computer program product, such as a computer program means, can for example be provided or supplied as a storage medium such as a memory card, USB stick, CD-ROM or DVD or also in the form of a file which can be downloaded from a server in a network. This can take place, for example, in a wireless communications network through the transmission of a corresponding file with the computer program product or the computer program means.

Further possible implementations of the invention also comprise combinations—not explicitly cited—of features or forms of embodiment described above or below in respect of the exemplary embodiments. Here the person skilled in the art will also add individual aspects as improvements or amendments to the respective basic form of the invention.

BRIEF DESCRIPTION OF THE DRAWINGS

Further advantageous embodiments and aspects of the invention are the subject matter of the dependent claims as well as the exemplary embodiments of the invention described below. The invention is described below in greater detail on the basis of preferred forms of embodiment with reference to the attached figures.

DETAILED DESCRIPTION OF EXEMPLARY EMBODIMENTS OF THE PRESENT INVENTION

Figure 1:
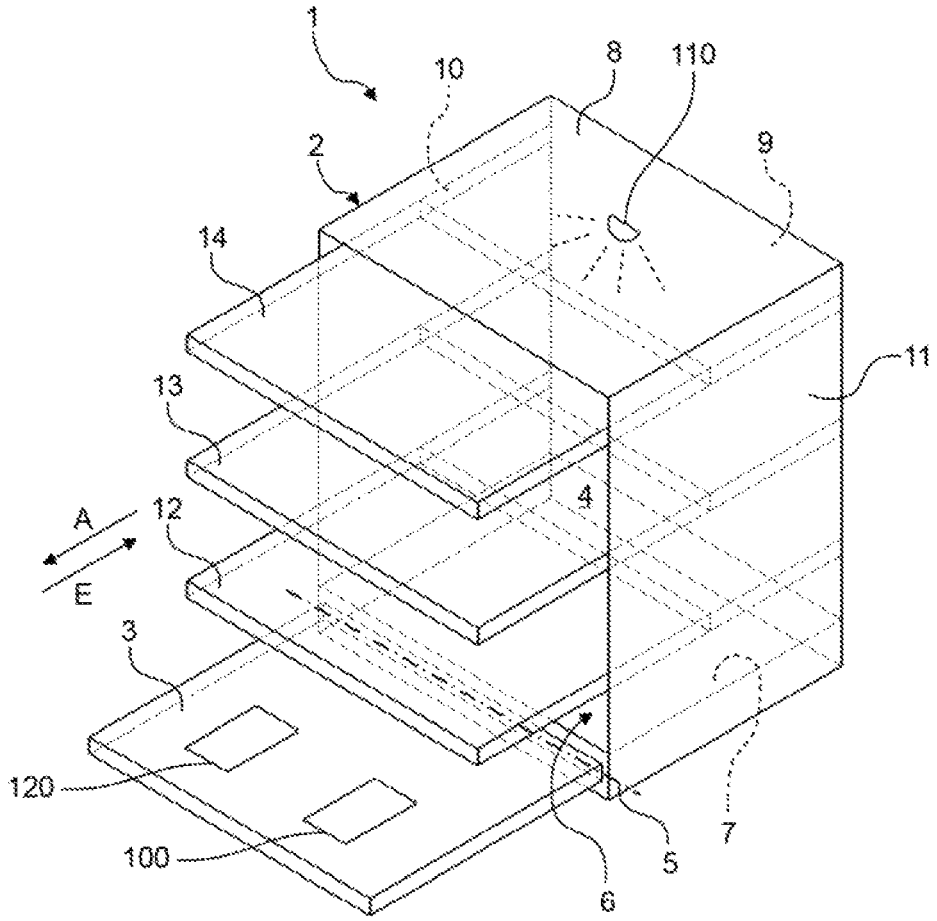
FIG. 1 shows a schematic perspective view of an exemplary embodiment of a household dishwasher.

In the figures, elements that are identical or have the same function are denoted by the same reference characters unless otherwise stated.

FIG. 1 shows a schematic perspective view of an exemplary embodiment of a household dishwasher 1. The household dishwasher 1 has a dishwasher cavity 2, which can be closed by a door 3, in particular in a watertight manner. A sealing facility can be provided for this purpose between the door 3 and the dishwasher cavity 2 (not shown). The dishwasher cavity 2 is preferably cuboid in shape. The dishwasher cavity 2 can be arranged in a housing of the household dishwasher 1. The dishwasher cavity 2 and the door 3 can form a washing compartment 4 for washing items to be washed 15.

The door 3 is shown in its open position in FIG. 1. The door 3 can be closed or opened by pivoting about a pivot axis 5 provided at a lower end of the door 3. With the aid of the door 3, a loading opening 6 of the dishwasher cavity 2 can be closed or opened. The dishwasher cavity 2 has a base 7, a ceiling 8 arranged opposite to the base 7, a rear wall 9 arranged facing the closed door 3 and two side walls 10, 11 arranged facing one another. The base 7, the ceiling 8, the rear wall 9 and the side walls 10, 11 may be manufactured from a stainless steel sheet for example. Alternatively, the base 7 may be manufactured from a plastic material.

Furthermore, the household dishwasher 1 has at least one receptacle for items to be washed 12, 13, 14. Preferably, a plurality of receptacles for items to be washed 12, 13, 14, for example three, are provided, wherein the receptacle for items to be washed 12 may be a lower receptacle for items to be washed or a lower basket, the receptacle for items to be washed 13 may be an upper receptacle for items to be washed or an upper basket, and the receptacle for items to be washed 14 may be a cutlery drawer. As additionally shown in FIG. 1, the receptacles for items to be washed 12, 13, 14 are arranged above one another in the dishwasher cavity 2. Each receptacle for items to be washed 12 to 14 is optionally able to be shifted into or out of the dishwasher cavity 2. In particular, each receptacle for items to be washed 12, 13, 14 is able to be inserted into the dishwasher cavity 2 in an insertion direction E and extracted from the dishwasher cavity 2 in an extraction direction A opposite to the insertion direction E.

The household dishwasher 1 also has a control device 100 and an evaluation unit 120, which are arranged on the door 3. An optical sensor 110 embodied as a camera is arranged on the ceiling 8 such that it is configured to acquire an optical sensor signal of the washing compartment 4 and in particular of the items to be washed 15 arranged therein (see FIG. 2). The dashed lines below the camera 110 indicate an acquisition region of the camera 110.

Figure 2:
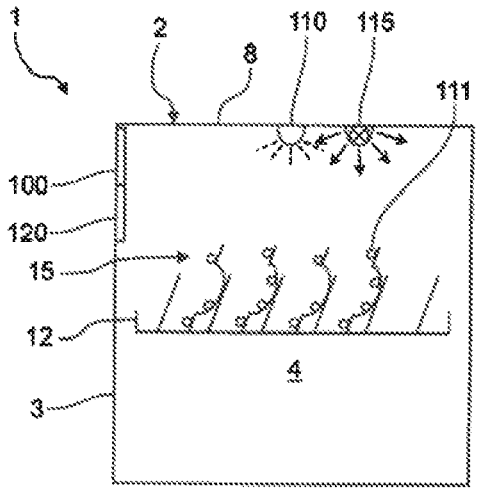
FIG. 2 shows a schematic side view of a further exemplary embodiment of a household dishwasher.

Through the combination of the camera 110 and the evaluation unit 120, it is advantageously possible to identify a drying state of items to be washed 15 arranged in the washing compartment 4 (see FIG. 2). This is explained in more detail below with reference to FIG. 2.

FIG. 2 shows a schematic side view of a further embodiment of a household dishwasher 1, such as the household dishwasher 1 from FIG. 1, with items to be washed 15 arranged on a receptacle for items to be washed 12 in a washing compartment 4. In this representation, the door 3, on which a control device 100 and an evaluation unit 120 are arranged, is shown in the closed position so that the door 3 and the dishwasher cavity 2 together form the washing compartment 4. The situation shown corresponds for example to a situation that arises during a drying program sub-step. In this representation, the items to be washed 15 are partially wetted with water drops 111.

An optical sensor 110 and a lighting device 115 are arranged on the ceiling 8 of the dishwasher cavity 2. The optical sensor is embodied for example as a CCD sensor with a lens, and is configured to record an image of the items to be washed 15 arranged in the washing compartment 4 in a broad spectral range of between a few micrometers and several hundred nanometers. The acquisition region is indicated by dashed lines below the optical sensor 110. The lighting device 115 is embodied as a broadband flash unit. The direction of illumination is indicated by arrows below the flash unit 115. In particular, the flash unit 115 illuminates the entire washing compartment 4 and the items to be washed 15 arranged therein.

In order to identify the drying state of the items to be washed 15, for example a closure of the optical sensor 110 is opened, the flash unit 115 is actuated to emit a flash in order to illuminate the washing compartment 4 and the items to be washed 15, and then the closure of the optical sensor 110 is reclosed. This operation takes for example between $1/1000$ s and 1 s. The CCD sensor of the optical sensor 110 is then read out and the digital image signal thus acquired is transmitted to the evaluation unit 120. The evaluation unit 120 thereupon analyzes the image signal and identifies a drying state of the items to be washed 15. In the example shown, the evaluation unit 120 would for example identify that the items to be washed 15 are still wet. For example, the evaluation unit 120 thereupon activates a zeolite drying device (not shown) in order to accelerate and/or complete the drying operation.

Figure 3:
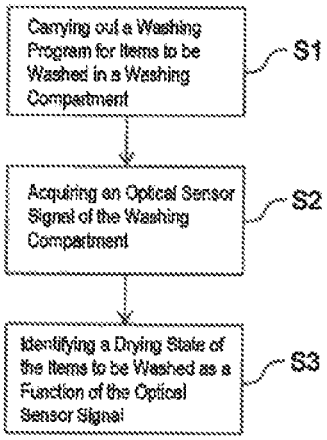
FIG. 3 shows a schematic block diagram of an exemplary embodiment of a method for operating a household dishwasher.

FIG. 3 shows a schematic block diagram of a method for operating a household dishwasher 1, such as the household dishwasher 1 from FIG. 1 or FIG. 2, with a control device 100, an optical sensor 110 and an evaluation unit 120.

In a first method step S1, the control device 100 carries out a washing program selected from a number of washing programs for washing items to be washed 15 arranged in the washing compartment. In particular, the washing program has a drying as the final program sub-step, during which the items to be washed 15 are dried.

In a second method step S2, which takes place in particular during the drying program sub-step, the optical sensor 110 acquires an optical sensor signal of the washing compartment 4 and in particular of the items to be washed 15.

In a third method step S3, the evaluation unit 120 identifies a drying state of the items to be washed 15 as a function of the optical sensor signal acquired by the optical sensor 110.

In further, optional method steps, it is provided for example that the identified drying progress is output on a display element of the household dishwasher 1 and/or measures to improve the drying are initiated. In particular, a development of the drying over time can be shown and/or predicted. For this purpose, for example, several drying states of the items to be washed 15 identified at predetermined intervals are considered as a whole. It can be provided that a mathematical function representing an empirical development of the drying over time is adapted to the identified drying states, as a result of which a prediction for the subsequent progress of the drying over time is produced.

Although the present invention has been described with reference to exemplary embodiments, it can be modified in numerous different ways.

The invention claimed is:

1. A household dishwasher, comprising:

a washing compartment receiving items to be washed;

a control device configured to carry out a washing program selected from a number of washing programs for washing the items to be washed in the washing compartment;

an optical sensor configured to acquire an optical sensor signal of the items to be washed in the washing compartment;

a lighting device for illuminating the washing compartment during acquisition of the optical sensor signal, the lighting device being configured to illuminate the items to be washed in the washing compartment during acquisition of the optical sensor signal; and an evaluation unit configured to identify a drying state of the items to be washed in the washing compartment as a function of the acquired optical sensor signal, wherein the identification of the drying state of the items to be washed is accomplished by analyzing the acquired optical sensor signal to detect at least one of molecular water, water drops, and/or regions wetted with water on the items to be washed, wherein the evaluation unit is configured to trigger a predetermined action as a function of the identified drying state of the items to be washed, wherein the predetermined action comprises an output of a notification signal, and wherein the output of the notification signal comprises an output of a signal to a mobile device or an app installed on the mobile device of a user, such that the user is informed about an optimum point in time at which to remove the items to be washed as a function of the identified drying state.

2. The household dishwasher of claim 1, wherein the optical sensor is embodied as a camera, with the optical sensor signal comprising an image of the washing compartment.

3. The household dishwasher of claim 2, wherein the evaluation unit is configured to carry out an image analysis of the acquired image in order to identify the drying state of the items to be washed.

4. The household dishwasher of claim 1, wherein the optical sensor is embodied as an infra-red sensor.

5. The household dishwasher of claim 4, wherein the infra-red sensor is configured to acquire a temperature of the items to be washed and to acquire a relative air humidity of air in the washing compartment, said evaluation unit being configured to identify the drying state of the items to be washed as a function of the acquired temperature of the items to be washed and the acquired relative air humidity.

6. The household dishwasher of claim 1, wherein the predetermined action further comprises a termination of the washing program, an extension of the washing program, a setting of a parameter value of the washing program, and/or an actuation of a component of the household dishwasher.

7. The household dishwasher of claim 1, wherein the evaluation unit performs an analysis of an infra-red spectral range of the acquired optical sensor signal to detect the molecular water.

8. The household dishwasher of claim 1, wherein the optical sensor is a camera, and wherein the evaluation unit performs an image analysis to detect the water drops and/or the regions wetted with water on the items to be washed.

9. The household dishwasher of claim 1, wherein the drying state includes a prediction over a period of time as to when the items to be washed will be dry.

10. A method for operating a household dishwasher, comprising:

executing by a control device a washing program selected from a number of washing programs for washing items to be washed arranged in a washing compartment of the household dishwasher;

acquiring by an optical sensor an optical sensor signal of the washing compartment;

illuminating by a lighting device the washing compartment during acquisition of the optical sensor signal, the lighting device being configured to illuminate the items to be washed in the washing compartment during acquisition of the optical sensor signal; and identifying by an evaluation unit a drying state of the items to be washed in the washing compartment as a function of the acquired optical sensor signal, wherein the identification of the drying state of the items to be washed is accomplished by analyzing the acquired optical sensor signal to detect at least one of molecular water, water drops, and/or regions wetted with water on the items to be washed, wherein the evaluation unit is configured to trigger a predetermined action as a function of the identified drying state of the items to be washed, wherein the predetermined action comprises an output of a notification signal, and wherein the output of the notification signal comprises an output of a signal to a mobile device or an app installed on the mobile device of a user, such that the user is informed about an optimum point in time at which to remove the items to be washed as a function of the identified drying state.

11. A computer program product for operating a household dishwasher, comprising a program-controlled device having stored therein a computer program embodied in a non-transitory computer readable medium, wherein the computer program, when loaded into the program-controlled device and executed by the program-controlled device, causes the program-controlled device to execute the steps of:

executing by a control device a washing program selected from a number of washing programs for washing items to be washed arranged in a washing compartment of the household dishwasher;

acquiring by an optical sensor an optical sensor signal of the washing compartment;

illuminating by a lighting device the washing compartment during acquisition of the optical sensor signal, the lighting device being configured to illuminate the items to be washed in the washing compartment during acquisition of the optical sensor signal; and identifying by an evaluation unit a drying state of the items to be washed in the washing compartment as a function of the acquired optical sensor signal, wherein the identification of the drying state of the items to be washed is accomplished by analyzing the acquired optical sensor signal to detect at least one of molecular water, water drops, and/or regions wetted with water on the items to be washed, wherein the evaluation unit is configured to trigger a predetermined action as a function of the identified drying state of the items to be washed, wherein the predetermined action comprises an output of a notification signal, and wherein the output of the notification signal comprises an output of a signal to a mobile device or an app installed on the mobile device of a user, such that the user is informed about an optimum point in time at which to remove the items to be washed as a function of the identified drying state.

12. A household dishwasher, comprising:

a washing compartment receiving items to be washed;

a control device configured to carry out a washing program selected from a number of washing programs for washing the items to be washed in the washing compartment;

an optical sensor configured to acquire an optical sensor signal of the items to be washed in the washing compartment; and an evaluation unit configured to identify a drying state of the items to be washed in the washing compartment, further comprising:

a further optical sensor configured to acquire a further optical sensor signal of the washing compartment and/or of the items to be washed, the further optical sensor being integrated in a mobile device, and the further optical sensor signal being transmitted wirelessly from the mobile device to the evaluation unit, wherein the evaluation unit is configured to identify the drying state as a function of both the acquired optical sensor signal and the further optical sensor signal.

* * * * *